313-414 SR
8/17/82 XR 4,345,183

United States Patent [19]
Fukuda

[11] 4,345,183
[45] Aug. 17, 1982

[54] COLOR PICTURE TUBE WITH MAGNETIC FOCUSING SYSTEM

[75] Inventor: Kyohei Fukuda, Mobara, Japan

[73] Assignee: Hitachi, Ltd., Tokyo, Japan

[21] Appl. No.: 917,179

[22] Filed: Jun. 20, 1978

[30] Foreign Application Priority Data

Jun. 20, 1977 [JP] Japan ..... 52/72058

[51] Int. Cl.³ ..... H01J 29/52
[52] U.S. Cl. ..... 313/412; 313/414
[58] Field of Search ..... 313/412, 413, 414, 411, 313/409 (U.S. only), 441, 442, 443

[56] References Cited

U.S. PATENT DOCUMENTS

| | | | |
|---|---|---|---|
| 2,149,101 | 2/1939 | Ploke | 313/443 |
| 2,733,364 | 1/1956 | Flory | 313/443 X |
| 2,804,548 | 8/1957 | Ruska | 313/443 X |
| 3,217,200 | 11/1965 | Gethmann | 313/443 |
| 4,119,884 | 10/1978 | Blumenberg et al. | 313/414 X |
| 4,143,293 | 3/1979 | Hosokoshi et al. | 313/409 |

FOREIGN PATENT DOCUMENTS

| | | | |
|---|---|---|---|
| 734764 | 6/1943 | Fed. Rep. of Germany | 313/414 |
| 50-26274 | of 1975 | Japan | 313/412 |

*Primary Examiner*—Robert Segal
*Attorney, Agent, or Firm*—Craig and Antonelli

[57] ABSTRACT

A pair of disc-shaped members of magnetic material each having three through holes for passing the beams emitted from three electron guns R, G and B are arranged in parallel to each other within the glass neck of a color picture tube. An annular permanent magnet is provided on the outer surface of the glass neck at a position nearest to the outer periphery of each of the disc-shaped members of magnetic material. The annular permanent magnet for magnetizing one of the members has an S pole at its part nearer to the outer surface of the glass tube and an N pole at its part farther from the outer surface of the glass tube, while the other annular permanent magnet for magnetizing the other member of magnetic material has N and S poles nearer to and farther from the glass tube respectively. Thus, the periphery of each through hole of one of the members of magnetic material is magnetized to S pole and that of the other member to N pole, so that lines of magnetic force are produced from the through holes of one member to those of the other member, thereby forming three focusing magnetic lenses with axes thereof coincident with routes of beam travel respectively.

14 Claims, 6 Drawing Figures

COLOR PICTURE TUBE WITH MAGNETIC FOCUSING SYSTEM

BACKGROUND OF THE INVENTION

1. Field of the Invention

This invention relates to a color picture tube having a plurality of electron guns and a magnetic focusing system.

2. Description of Prior Art

Japanese Utility Model Publication No. 26274/75 discloses a picture tube with a single electron gun having means provided on the outer or inner surface of the tube neck for generating a magnetic field for beam focusing, and a pair of members of magnetic material high in magnetic permeability each having one through hole for passing one electron beam inside the tube where the beam-focusing magnetic field is present, the members of magnetic material being spaced to each other in the direction of beam travel, i.e., along the tube axis so that the focusing magnetic field is strengthened on the one hand and a focusing magnetic lens with orderly magnetic field distribution is formed on the other hand between the pair of the members of magnetic material high in magnetic permeability.

This focusing system is such that the pair of members of magnetic material absorb and discharge the lines of magnetic force for concentration thereof, thus stengthening the magnetic field between the members of magnetic material, and therefore a magnetic field-generating device is available which is small in shape and weight, i.e., small in magnetomotive force on the one hand and by improving the dimensional accuracy of the members of magnetic material, the accuracy of the magnetic lens, is improved thus making it possible to use a magnetic field-generating device having a distribution of magnetic field low in accuracy on the other hand, leading to a superior picture tube of magnetic focusing type.

In application thereof to a color picture with a plurality of electron guns, however, such a focusing system has the disadvantages as mentioned below.

Assume, for instance, that such a focusing system is used with a color picture tube of 20-inch, 110°-deflection type with neck diameter of 29 mm and having three in-line electron guns horizontally arranged and spaced 6.6 mm from each other. The focal length of the focusing magnetic lens is substantially equal to the distance from the crossover point near the first grid and the center of the magnetic lens, which distance is much shorter than the distance from the center of the magnetic lens to the phosphor screen 31. As a result, the three electron beams that have passed the magnetic lens cross each other at a point far from the phosphor screen 31 and are spaced so widely from each other on the phosphor screen 31 that the center beam is distant about 40 mm from the side beams on the phosphor screen 31. Further, the physical positions of the three electron guns are so distant from each other that when the travel route of the electron beam of one of the electron guns is determined along the lens axis, the other two electron beams pass along the margin of the magnetic lens, with the result that the astigmatism and coma for the particular two electron beams are increased, thus leading to the deformation of beam spots.

SUMMARY OF THE INVENTION

Accordingly, it is an object of the present invention to provide a color picture tube with a magnetic focusing system, in which a plurality of electron beams emitted from a plurality of electron guns have a small distance from each other on the phosphor screen.

Another object of the present invention is to provide a color picture tube with a magnetic focusing system in which the spots of the plurality of electron beams are not deformed.

In order to achieve the above objects, according to the present invention, there is provided a color picture tube with a magnetic focusing system comprising a pair of members of magnetic material arranged in spaced relation to each other in the direction of travel route of electron beams, each of the members having a plurality of through holes for passing the plurality of electron beams respectively, one of the members having the periphery of the through holes thereof magnetized to a polarity opposite to that of the periphery of the through holes of the other member, thereby forming a magnetic lens between each corresponding pair of the through holes passing the electron beams.

DESCRIPTION OF THE PREFERRED EMBODIMENTS

Figure 1:
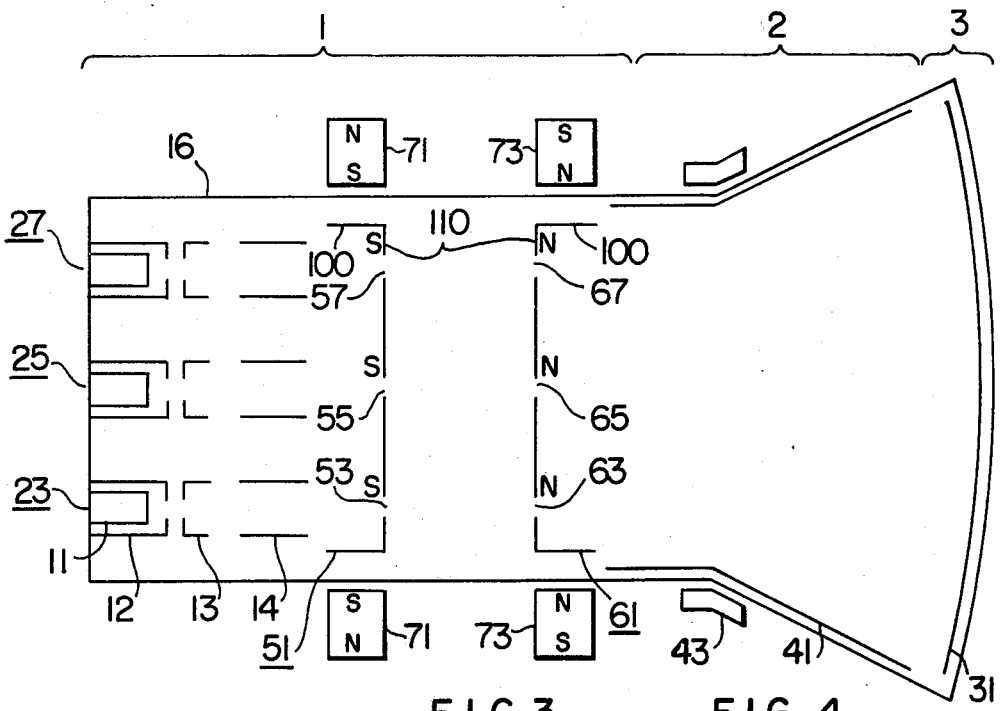
FIG. 1 is a cross sectional view showing an embodiment of the color picture tube of magnetic focusing type according to the present invention.

In FIG. 1, a neck 1 is shown enlarged as compared with a funnel 2 and a panel 3. Three electron guns 23, 25 and 27 each including a cathode 11, a first grid 12, a second grid 13 and a third grid 14 emit electron beams associated with the primary color signals of red, green and blue toward a phosphor screen 31 of the panel 3. The electron beams thus emitted pass through substantially the centers of through holes 53, 55 and 57 of a member of magnetic material 51 high in magnetic permeability, through the centers of through holes 63, 65 and 67 of the other member of magnetic material 61 respectively, accelerated by an anode 41 impressed with a high voltage, and then impinge on the phosphor screen 31. In the process, the electron beam raster-scan the whole of the phosphor screen by the deflecting magnetic field generated by a deflection yoke 43. An annular permanent magnet 71 is magnetized at S polarity on the side thereof nearer to the picture tube surface 16, and at N polarity on the opposite side thereof, while an annular permanent magnet 73 is magnetized at N polarity on the side thereof nearer to the tube surface 16, and at S polarity on the opposite side thereof. Both of the annular permanent magnets are secured to the picture tube surface 16 by a bonding agent. Instead of securing the magnets to the tube surface 16 by a bonding agent, a magnetic shield case open at the tube surface side thereof may be covered on the annular permanent magnets 71 and 73 and fixed on the tube surface 16.

Figure 2A:
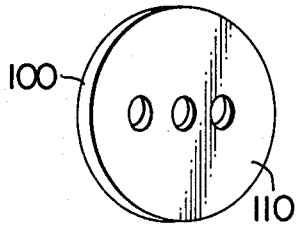
FIG. 2A is a perspective view of the member of magnetic material used in the embodiment of FIG. 1.

The members of magnetic material 51 and 61 have a shape as shown in FIG. 2A and each of them comprises a cylindrical portion 100 and a disc portion having through holes 53, 55 and 57 or 63, 65 and 67. The members of magnetic material 51 and 61 are secured to the neck 1 in a manner similar to that for the electron guns 23, 25 and 27. Alternatively, the member of magnetic material 51 may be coupled mechanically to the third grid 14, so that the member of magnetic material 51 thus coupled to the third grid 14 is coupled with the member of magnetic material 61 by a non-magnetic material in such a manner as not to prevent the passage of the electron beams.

The magnetic fluxes generated from the N pole of the annular permanent magnet 73 are absorbed into the cylindrical portion 100 of the member of magnetic material 61 and through the through holes 63, 65 and 67, emitted toward the through holes 53, 55 and 57 of the member of magnetic material 51 respectively. The magnetic fluxes absorbed into through holes 53, 55 and 57 are absorbed into the S pole of the annular permanent magnet 71 from the cylindrical portion 100 of the member of magnetic material 51. In other words, the peripheries of the through holes 63, 65 and 67 are magnetized to N polarity, and the peripheries of the through holes 53, 55 and 57 to S polarity, thus forming magnetic lenses between through holes 53, 55, 57; and 63, 65, 67 respectively. The magnetic field forming each of the magnetic lenses is distributed substantially symmetrically with respect to an axis connecting the centers of the through holes 53, 55 and 57 and the centers of the through holes 63, 65 and 67. Therefore, the electron beams are not subjected to any astigmatism or coma when passing through the centers of the through holes 53, 63; 55, 65; and 57, 67 respectively. Further, in view of the fact that a magnetic lens having an axis coincident with the travel route of each of the electron beams is formed for each electron beam, the distance between the electron beams on the phosphor screen is not large as compared with the case where three electron beams are focused by one magnetic lens.

Figure 3:
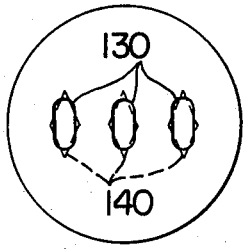
FIGS. 3 and 4 are front views showing other embodiments of the members of magnetic material.
Figure 4:
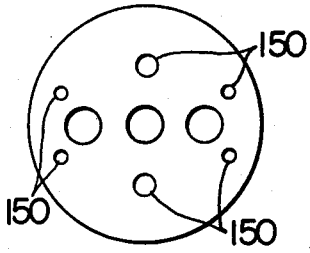
Figure 2B:
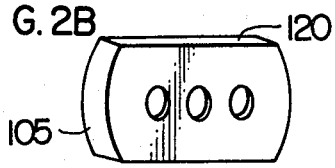
FIG. 2B is a perspective view showing another example of the member of magnetic material used in the embodiment of FIG. 1.

The member of magnetic material 51 or 61 is not necessarily symmetric with respect to the axis of the picture tube but may take a cylindrical form having curved sides 105 and plane sides 120 forming parts of the cylinder as shown in FIG. 2B. In the case of a color picture tube of in-line type with the electron guns 23, 25 and 27 aligned horizontally, the through holes 53, 55, 57; and 63, 65, 67 are also aligned horizontally, so that different magnetic resistances are offered in horizontal and vertical directions against the magnetic field symmetric with respect to the tube axis, which is generated from the annular permanent magnets 71 and 73, thus making it impossible to form a magnetic field distribution completely symmetric with respect to tube axis. In order to compensate for this inconvenience, the through holes are lengthened vertically as compared with horizontally as shown by the solid lines 130 and dashed lines 140 in FIG. 3, or openings 150 are formed above and under the through holes as shown in FIG. 4.

As a source of the focusing magnetic field, the two annular permanent magnets 71 and 73 may be replaced by a single annular permanent magnet with S and N poles located on the sides thereof nearer to the electron guns 23, 25, 27; and on the side nearer to the phosphor screen 31 respectively. As another alternative, the permanent magnet may be replaced by an electromagnet with equal effect.

Figure 5:
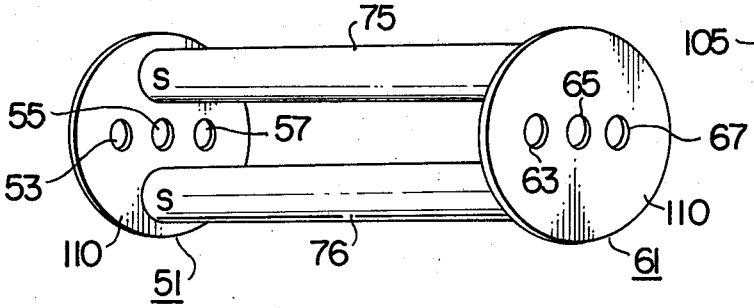
FIG. 5 is a perspective view showing another focusing system of the color picture tube of magnetic focusing type according to the present invention.

The diagram of FIG. 5 shows an example in which, in order to contain the magnetic focusing system in the neck 1, the permanent bar magnets 75 and 76 and the members of magnetic material 51 and 61 are integrated with each other. The S and N pole ends of the permanent bar magnets 75 and 76 are fittingly coupled to the upper and lower parts of the disc portions 110 respectively by a bonding agent. The peripheries of the through holes 53, 55 and 57 of the disc portion 110 making up the member of magnetic material 51 are coupled with the third grids 14 of the electron guns 23, 25 and 27 respectively, so that the whole of the members of magnetic material 51 and 61 and the permanent bar magnets 75 and 76 are secured to the third grids 14.

I claim:

1. A color picture tube having a plurality of electron guns disposed in-line in a neck portion of said tube, said magnetic focusing means comprising a pair of magnetic members of high permeability with through holes disposed in-line in a horizontal direction of the tube for permitting electron beams emitted from the electron guns to pass therethrough, respectively, said pair of magnetic members being disposed separately in the tube axial direction in the neck portion, and magnetizing means for magnetizing one of said pair of magnetic members in one polarity and the other of said pair of magnetic members in the other polarity to produce a plurality of magnetic focusing lenses, each of said magnetic focusing lenses being present between mutually opposed through holes of said pair of magnetic members, each of said magnetic focusing lenses having a non-symmetric magnetic field distribution with respect to the lens axis coinciding with a path of the electron beam proceeding therethrough when said through holes have a shape symmetric with respect to the lens axis, said magnetic focusing means further including compensating means for modifying said non-symmetric magnetic field distribution of each of said magnetic focusing lenses to a symmetric magnetic field which is symmetric with respect to the lens axis.

2. A color picture tube according to claim 1, in which the center of each of said through holes is coincident with the travel route of each of said electron beams.

3. A color picture tube according to claim 1, in which said neck includes a section for housing said electron guns and said magnetizing means is mounted on the outer surface of said housing section.

4. A color picture tube according to claim 1, in which said neck includes a section for housing said electron guns and said magnetizing means is mounted within said housing section.

5. A color picture tube according to claim 4, in which each of said members of magnetic material includes a flat plate having a plurality of through holes, said magnetizing means being provided between a pair of said flat plates.

6. A color picture tube according to claim 5, in which said magnetizing means comprises at least one bar magnet, one pole end of said bar magnet being secured to one of said flat plates, the other pole end of said bar magnet being secured to the other of said flat plates.

7. A color picture tube according to claim 6, in which each of said flat plates includes three through holes aligned in horizontal direction, a pair of said bar magnets being secured to the parts of said flat plates above and under said through holes respectively.

8. A color picture tube according to claim 1, in which each of said members of magnetic material includes a cylindrical portion in proximity to said magnetizing means and a flat portion integrated with said cylindrical portion and having a plurality of through holes.

9. A color picture tube according to claim 1, wherein said compensating means causes a magnetic intensity in a direction perpendicular to a disposition direction of said electron guns in each magnetic focusing lens to be weakened with respect to that in said disposition direction in each magnetic focusing lens.

10. A color picture tube according to claim 1, wherein said compensating means comprises compensating bores provided in each of said magnetic members above and beneath an array of said through holes which are provided for the passage of the electrons.

11. A color picture tube according to claim 1, wherein said compensating means includes each of said through holes being provided with a non-circular aperture to compensate for the non-symmetry.

12. A color picture tube according to claim 11, wherein said through holes are aligned in the horizontal direction, and each of said through holes is longer vertically than horizontally so as to provide the non-circular aperture.

13. A color picture tube having a plurality of electron guns disposed in-line in a neck portion of said tube, and magnetic focusing means comprising a pair of magnetic members of high permeability with through holes disposed in-line in a horizontal direction of the tube for permitting electron beams emitted from the electron guns to pass therethrough, respectively, said pair of magnetic members being disposed separately in the tube axial direction in the neck portion, magnetizing means for magnetizing one of said pair of magnetic members in one polarity and the other of said pair of magnetic members in the other polarity to produce a plurality of magnetic focusing lenses, each of said magnetizing focusing lenses being present between mutually opposed through holes of said pair of the magnetic members so as to have a lens axis coinciding with a center-to-center line of the mutually opposed through holes, and a plurality of compensating means, respective compensating means being provided for respective magnetic focusing lenses for modifying a magnetic field distribution of a corresponding lens so as to make the magnetic field distribution of each of the respective lenses symmetric with respect to the lens axis.

14. A color picture tube having a plurality of electron guns disposed in-line in a neck portion of said tube, and magnetic focusing means comprising a pair of magnetic members of high permeability with through holes disposed in-line in a horizontal direction of the tube for permitting electron beams emitted from the electron guns to pass therethrough, respectively, said pair of magnetic members being disposed separately in the tube axial direction in the neck portion, magnetizing means for magnetizing one of said pair of magnetic members in one polarity and the other of said pair of magnetic members in the other polarity to produce a plurality of magnetic focusing lenses, each of said magnetic focusing lenses being present between mutually opposed through holes of said pair of the magnetic members so as to have a lens axis coinciding with a center-to-center line of the mutually opposed through holes, and a plurality of compensating means, respective compensating means being provided for respective magnetic focusing lenses for modifying a magnetic field distribution of a corresponding lens, each of said through holes of respective magnetic focusing lenses having a shape symmetric with respect to the lens axis so that each of said magnetic focusing lenses has a non-symmetric magnetic field distribution with respect to the lens axis due to the in-line alignment of said through holes, and said compensating means modifying the magnetic field distribution of respective lenses to be weaker in the vertical direction than in the horizontal direction to thereby obtain a symmetric magnetic field distribution.

* * * * *